US005713681A

United States Patent [19]

Venne et al.

[11] Patent Number: 5,713,681

[45] Date of Patent: Feb. 3, 1998

[54] BINGO CARD INK MARKER BOTTLE

[75] Inventors: Clarence J. Venne, Yardley; Richard A. Venne, Sr., Bensalem, both of Pa.

[73] Assignee: Clarence J. Venne, Inc., Levittown, Pa.

[21] Appl. No.: 530,810

[22] Filed: Sep. 20, 1995

[51] Int. Cl.[6] ..... B43K 8/02; B43K 29/00

[52] U.S. Cl. ..... 401/202; D9/539; 40/306

[58] Field of Search ..... 401/202; 40/306, 40/310; 215/1 C; D9/537, 538, 539, 540, 541, 542, 543, 500, 530

[56] References Cited

U.S. PATENT DOCUMENTS

| | | | |
|---|---|---|---|
| D. 209,715 | 12/1967 | Ninesling et al. | D9/539 |
| D. 274,697 | 7/1984 | Venne | D9/352 |
| D. 300,118 | 3/1989 | Venne et al. | D9/350 |
| D. 303,926 | 10/1989 | Venne et al. | D9/349 |
| D. 352,242 | 11/1994 | Crawford et al. | D9/530 X |
| 2,356,399 | 8/1944 | Hansen | 40/306 |
| 4,387,816 | 6/1983 | Weckman | 215/1 C |
| 4,946,053 | 8/1990 | Conrad | 215/1 C |

*Primary Examiner*—Steven A. Bratlie
*Attorney, Agent, or Firm*—Caesar, Rivise, Bernstein, Cohen & Pokotilow, Ltd.

[57] ABSTRACT

A BINGO card ink applicator bottle. The bottle is formed of a blow-molded plastic material and has a central longitudinal axis. The bottle holds a colored ink therein for marking a BINGO card and includes a shoulder portion, a central recessed portion, and a base portion. The shoulder portion includes a cylindrically circular sidewall and a top wall having a neck with a central opening therein. An ink applicator is mounted on the neck and in communication with the interior of the bottle. The base portion includes a cylindrically circular sidewall and planer bottom wall. The outside diameter of the sidewall of the shoulder portion is the same as the base portion. The central recessed portion includes an oval cylindrical sidewall having a major outside diameter and a minor outside diameter, with the major outside diameter being the same as that of the sidewall of the shoulder and base portions. The central recessed portion merges with the sidewall of the shoulder portion at an upper flared surface which is arranged to receive the thumb and index finger of one hand of a person holding the bottle so that he/she can use the applicator to mark a BINGO card. A label bearing indicia thereon is secured on the central recessed portion centered over at least one of the ends of the minor diameter to provide maximum visibility for that indicia.

15 Claims, 2 Drawing Sheets

FIG. 4
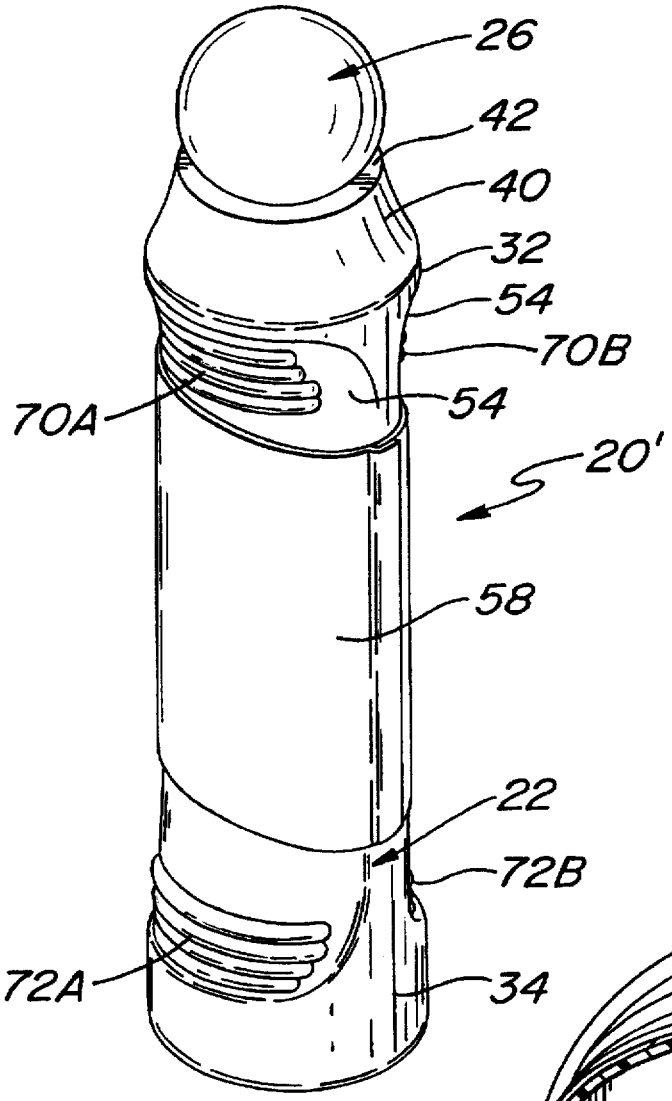
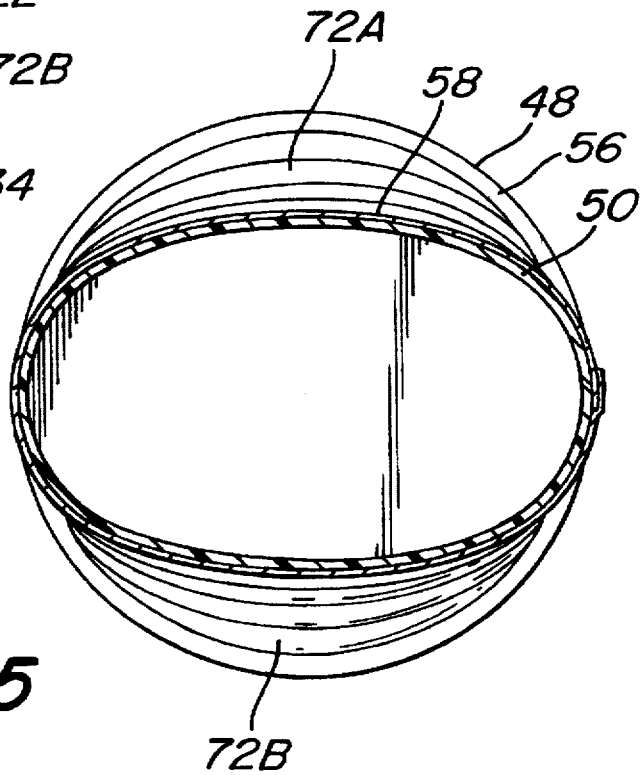
FIG. 5

BINGO CARD INK MARKER BOTTLE

BACKGROUND OF THE INVENTION

This invention relates generally to bottles and particularly to ink applicator bottles or markers for marking BINGO cards or items requiring the application of a colored mark thereon.

Various ink applicator bottles for use by persons to mark a BINGO card are commercially available. Some particularly effective applicator bottles are those sold by the assignee of the subject invention, Clarence J. Venne, Inc. of Levittown, Pa., under the trademark DAB-O-INK, and are shown in the following U.S. Design Pat. Nos.: D274,697, D300,118, and D303,926.

While the prior art applicator bottles, particularly those of the assignee of this invention, are suitable for their intended purposes, such bottles never the less still leave something to be desired from one or more standpoints, such as economics of manufacture, ergonomics, and effectiveness of labelling.

OBJECTS OF THE INVENTION

Accordingly, it is a general object of this invention to provide an ink applicator bottle which addresses those needs.

It is a further object of this invention to provide an ink applicator bottle which can be manufactured and filled easily.

It is another object of this invention to provide an ink applicator bottle which is ergonomically constructed to enable it to be easy to hold and use.

It is still another object of this invention to provide an ink applicator bottle which contains a large volume of ink.

It is yet another object of this invention to provide an ink applicator bottle which provides a large surface area on portions thereof for receipt of an indicia bearing label to render such indicia readily visible.

SUMMARY OF THE INVENTION

These and other objects of this invention are achieved by providing a BINGO card ink applicator bottle. The bottle is composed of a plastic material which is molded, e.g., injection blow-molded or extrusion blow molded, to form a hollow body having a central longitudinal axis and a cap for releasable securement to the bottle. The hollow body of the bottle is arranged to hold a colored ink therein for marking a BINGO card or other game card or item.

The bottle includes a shoulder portion, a central recessed portion, and a base portion. The shoulder portion of the bottle is located above the central recessed portion and includes a top wall having an opening therein. The base portion is located below the central recessed portion and includes a bottom wall. The shoulder portion includes a sidewall portion of circular periphery having a first predetermined outside diameter measured perpendicularly from the central longitudinal axis of the bottle. The base portion includes a sidewall portion of circular periphery having the same first predetermined outside diameter measured from the same axis as the shoulder portion. The central recessed portion includes an oval sidewall having a major outside diameter and a minor outside diameter. The major outside diameter measured perpendicularly from the central longitudinal axis is the same as the first predetermined outside diameter of the shoulder and base portions. The minor outside diameter is a lesser dimension than major outside diameter when measured perpendicularly from the central longitudinal axis.

The central recessed portion of the bottle merges with the sidewall portion of the shoulder at an upper flared surface. The upper flared surface is arranged to receive the thumb and index finger of one hand of a person holding the bottle.

The opening in the top wall has an ink applicator mounted thereon for receipt of ink from the interior of the bottle.

In accordance with one preferred embodiment of the invention a label is provided affixed to the central recessed portion of the bottle. The label bears indicia, e.g., fanciful graphics and/or text, located at minor axis to be readily visible.

DESCRIPTION OF THE DRAWINGS

Other objects and many attendant features of this invention will become readily appreciated as the same becomes better understood by reference to the following detailed description when considered in connection with the accompanying drawings wherein:

FIG. 4 is view, similar to FIG. 1, but showing an altenative embodiment of the bottle shown in FIG. 1; and FIG. 5 is view, similar to FIG. 3, but showing the altenative embodiment of the bottle shown in FIG. 4.

DETAILED DESCRIPTION OF THE PREFERRED EMBODIMENTS

Figure 1:
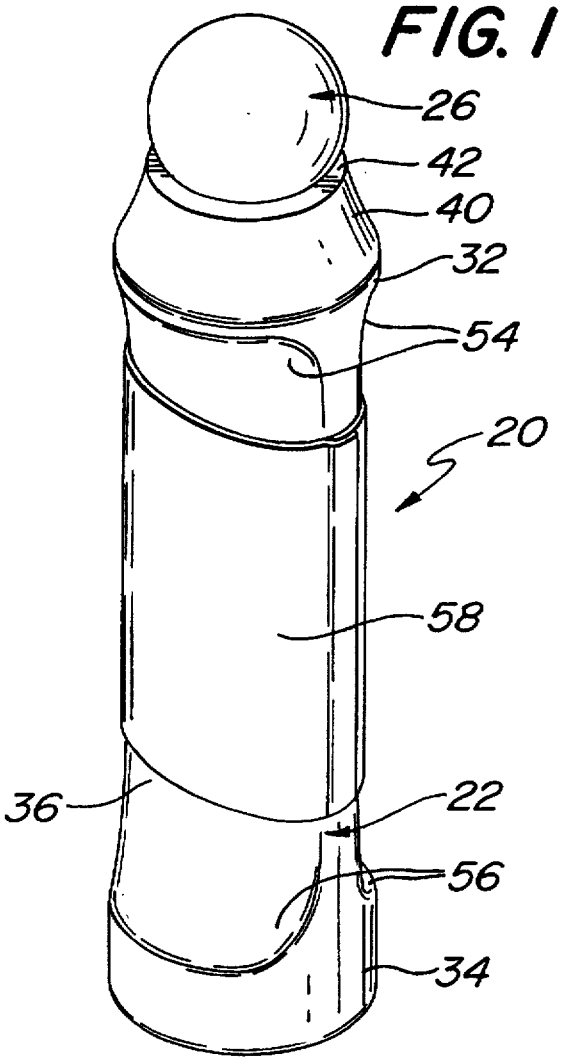
FIG. 1 is an isometric view of an ink applicator bottle of the subject invention.

Referring now to various figures of the drawing where like reference numerals refer to like parts there is shown at 20 in FIG. 1 an ink applicator bottle constructed in accordance with the subject invention. The bottle basically comprises a hollow body 22, an applicator 24 (FIG. 2), and a cap 26. The structural details of the body will be described later. Suffice it for now to state that the body includes a large hollow interior space or cavity for receipt of any conventional marking ink 28 therein. The applicator 24 can be of any conventional type. Preferably, it constitutes a spring valve applicator or other easy-flow applicator, such as included in the aforementioned DAB-O-INK bingo markers of applicants' assignee.

Figure 2:
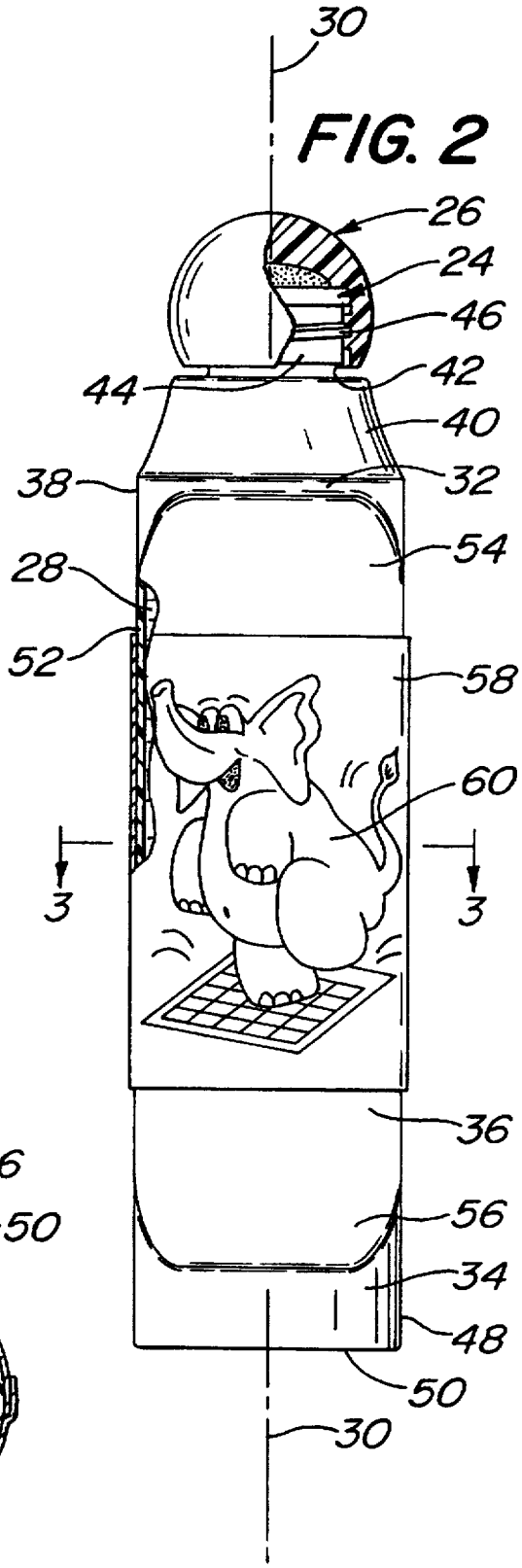
FIG. 2 is an enlarged side elevational view of the bottle shown in FIG. 1.

As can be seen in FIG. 2 the applicator 24 is mounted on the bottle's neck (to be described later) under the cap 26. The cap is threaded onto the bottle's neck to enable it to be readily removed to expose the applicator 24, when the ink applicator bottle 20 is to be used. The ink 28 within the interior of the bottle is in communication with the applicator 24 when the bottle is inverted, so that when the bottle with the cap removed is inverted and brought into engagement with a BINGO card (not shown) or other item to be marked, the applicator 28 will apply a circular blot of colored ink to that card or item. In particular, and as will be described later, the bottle is arranged to be held in the crook between the thumb and index finger, with the thumb and index finger resting on portions of the bottle so that the bottle can be inverted and manipulated like a pencil, pen, or other writing instrument.

When the applicator bottle is no longer needed to be used to mark a BINGO card, the cap 26 is screwed back onto the bottle's neck, thereby sealing off the applicator 28 from the ambient air and preventing it from drying out and/or allowing the ink to evaporate.

Figure 3:
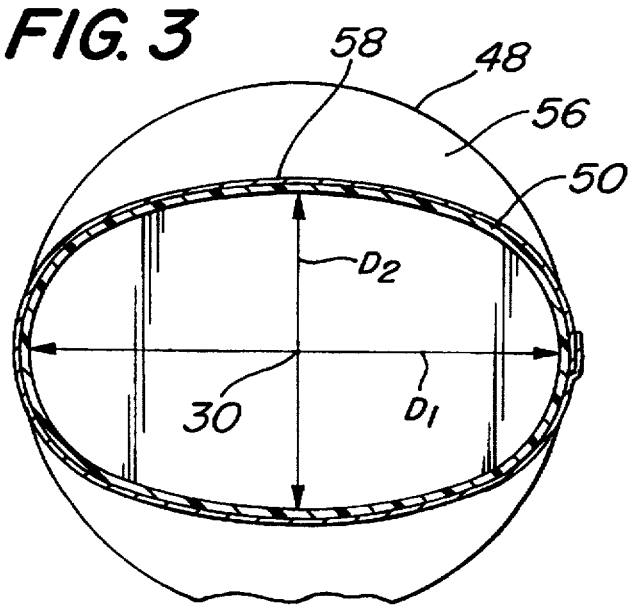
FIG. 3 is an enlarged sectional view taken along line 3—3 of FIG. 2.

The body of the bottle is formed of an suitable plastic material, which is preferably blow molded, by extrusion or injection, so that it is a unitary member of uniform wall thickness. As can be seen clearly in FIGS. 1–3 the body is an elongated member having a central longitudinal axis 30. The body includes a shoulder portion 32, a base portion 34, and a central recessed portion 36. The shoulder portion 32 includes a cylindrically circular sidewall 38 extending around the central axis 30, and having a predetermined exterior diameter, e.g., approximately 1.665 inch (42.3 mm), measured perpendicularly from the axis 30, a slightly concave conical intermediate sidewall 40 extending up from the circular sidewall 38, and a generally planar top wall 42. The top wall 42 includes an open circular neck 44 centered about the central longitudinal axis 30. A helical thread 46 extends about the neck. The applicator 24 is mounted on the top of the neck 42.

The base portion 34 includes a cylindrically circular sidewall 48 extending around the axis 30 and having the same predetermined exterior diameter measured perpendicularly from the central axis 30 as the sidewall of the shoulder portion 32. The base portion also includes a generally planar bottom wall 50. The bottle is arranged to be stored by seating it on a support surface (not shown) with its planar bottom wall in engagement therewith.

As will be appreciated by those skilled in the art the fact that the shoulder portion and the base portion each include a circular sidewall of the same outside diameter centered about the central longitudinal axis 30 enables the bottle to be readily molded and removed from the molding machine. Moreover, the bottle can be readily filled with ink 24 irrespective of its orientation within the filling machine.

The intermediate or central recessed portion 36 is constructed and sized to be held within the crook between the thumb and index finger of one hand of a person holding the bottle when the bottle is to be inverted, e.g., held like a pencil or pen, to mark a BINGO card. To that end the intermediate portion 36 is in the form of an oval sidewall 52 having a major outside diameter or axis D1 (FIG. 3) measured perpendicularly from the central longitudinal axis 30 and a minor outside diameter or axis D2 (FIG. 3) measured perpendicularly from that axis. The major outside diameter D1 is the same as the outside diameter of the sidewall 36 of the shoulder portion 32 and the outside diameter of sidewall 48 of the base portion 34. The minor outside diameter D2 is of a considerably lesser dimension than the major outside diameter, e.g., approximately 1.03 inch (26.16 mm). This feature ensures that the central portion is sufficiently narrow to enable it to be held very comfortably within the crook between the user's thumb and index finger, yet which enables the ink-holding capacity of the bottle to be larger than if the central portion of the bottle was of circular cylindrical shape having a single outside diameter equal to the minor outside diameter. The prior art bottles shown in the aforementioned design patents each have a recessed central portion, but of a circular cylindrical shape having a single outside diameter.

As can be seen in FIG. 2 the sidewall 52 of the central recessed portion 36 of the body merges with the sidewall 38 of the shoulder portion 32 at an upper flared surface 54. The upper flared surface is arranged to comfortably receive the thumb and index finger of one hand of a person holding the bottle when the bottle is to be held like a pencil or pen and inverted and its applicator brought into engagement with the BINGO card to mark that card. In the interest of aesthetics the sidewall 52 of central recessed portion 36 of the body merges with the sidewall 48 of the base portion 34 at a lower flared surface 56.

The oval central recessed portion 36 also serves to provide two larger viewing panels for one or more labels to be affixed thereto. For example, a single label 58 may be wrapped about and affixed to the central recessed portion 36 of the bottle 20. By virtue of the fact that the portions of the sidewall 52 making up the central recessed portion 36 contiguously located on either side of the ends of the minor diameter or axis D2 are each of a slight arc (see FIG. 3), any graphics or text on the label portion thereover will be readily visible (i.e., more visible than if the sidewall of the intermediate portion was of circular cylindrical shape having a single outside diameter equal to the minor outside diameter). In FIG. 2 there is shown the label 58 having a large fanciful character 60 of an elephant hopping on a bingo card disposed over the central recessed portion 36 contiguously located on either side of one of the ends of the minor diameter or axis D2 so as to be readily visible. Moreover, the shape of the intermediate portion 36 facilitates adherence of the label 58 thereto.

In FIGS. 4 and 5 there are shown an alternative embodiment of a bottle 20' constructed in accordance with this invention. The bottle 20' is identical in construction to the bottle 20 except for the inclusion of a plurality of raised ridges in the central recess portion 36 adjacent the bottle's shoulder 32 and base 34. In the interests of brevity the identical components of the bottles 20 and 20' will be given the same reference numerals and the details of the construction and use/operation of those components will not be reiterated herein.

As can be seen in FIGS. 4 and 5 there are two groups of ridges 70A and 70B in the central recessed portion 36 of the bottle immediately below the shoulder 32, i.e., the upper flared portion of the recess. There are plural, e.g., four, ridges in each of the groups 70A and 70B, and the ridges of each group are of graduated length starting from the uppermost of the ridges to the lower-most of the ridges. These two groups of ridges may facilitate the holding of the bottle between the thumb and index finger when the bottle is inverted to use it to apply a mark to a BINGO card. In particular, for some persons the ridges serve may as deterrant to gripping the bottle too close to the shoulder 32 portion to invert it for use, which action could result in a "top-heavy" feeling, particularly when the bottle is completely full of ink. Thus, the inclusion of the ridges 70A and 70B on the flared portions of the central recess immediately below the shoulder may induce those persons to grip the central recessed portion of the bottle further toward the center of the bottle when the bottle is very full, to avoid a "top heavy" feeling, yet permit those persons to grip the bottle on the ridges closer to the shoulder when the bottle is less full (and hence less prone to produce a "top heavy" feeling).

In the interests of aesthetics, e.g., symmetry, two groups of similar horizontally disposed ridges 72A and 72B are provided in the central recessed portion 36 of the bottle immediately above the base 34.

The height of the bottles 20 and 20' can be any dimension desired. One particularly effective height to provide a large capacity for ink-holding is a bottle having a height of approximately 6 inches (15.2 cm) measured from the base wall 50 to the top wall 42.

A smaller bottle may be constructed having a height of approximately 5 inches (12.7 cm) measured from the base wall to the top wall, and having a base and shoulder portion each having an outside diameter of approximately 1.54 inch (39.12 mm). This bottle has an intermediate recessed portion whose major outside is the same 1.54 inch (39.12 cm) as that of the base and shoulder portions, and whose minor outside diameter is approximately 1.012 inch (25.7 mm).

Other sizes are also contemplated within the scope of this invention.

The cap for the bottles 20 and 20' can be of any suitable shape in the interest of aesthetics, providing it includes interior threads for mating with the threads 44 of the bottle's neck. Thus, the partial spherical shaped cap 26 shown herein is merely exemplary. Another shape for the cap may be that shown in U.S. Design Pat. No. D318,621, which is assigned to the same assignee as this invention.

Without further elaboration the foregoing will so fully illustrate our invention that others may, by applying current or future knowledge, adapt the same for use under various conditions of service.

We claim:

1. A game card ink applicator bottle, said bottle being formed of a moldable plastic material and comprising a hollow body having a central longitudinal axis, said hollow body being arranged to hold a colored ink therein for marking a game card, said body including a shoulder portion, a central recessed portion, and a base portion, said shoulder portion being located above said central recessed portion and including a top wall having an opening therein, said base portion being located below said central recessed portion and including a bottom wall, said shoulder portion including a sidewall portion of circular periphery having a first predetermined outside diameter measured perpendicularly from said central longitudinal axis, said base portion including a sidewall portion of circular periphery having said first predetermined outside diameter measured perpendicularly from said central longitudinal axis, said central recessed portion including a smooth continuous oval sidewall having a major outside diameter and a minor outside diameter, said major outside diameter being less than approximately 2 inches (50.8 mm) and the same dimension as said first predetermined outside diameter measured perpendicularly from said central longitudinal axis, said minor outside diameter being approximately 1 inch (25.4 mm) measured perpendicularly from said central longitudinal axis, said opening having an ink applicator mounted thereon for receipt of ink from the interior of said bottle, said central recessed portion of said body merging with said sidewall portion of said shoulder portion at an upper flared surface, said upper flared surface being shaped to comfortably receive the thumb and index finger of one hand of a person to enable the person to hold said bottle so that said minor axis of said recessed portion of said bottle is located within the crook formed between the person's thumb and index finger to enable said bottle to be readily inverted to orient said applicator downward.

2. The bottle of claim 1 additionally comprising a label affixed to said central recessed portion, said label bearing indicia located immediately adjacent at least one end of said minor axis to be readily visible.

3. The bottle of claim 1 wherein said top wall includes a cylindrical neck portion in which said opening is located, said neck portion being arranged to have releasably secured thereto a cap to cover said ink applicator.

4. The bottle of claim 3 wherein said neck portion includes a helical thread thereon.

5. The bottle of claim 2 wherein said top wall includes a cylindrical neck portion in which said opening is located, said neck portion being arranged to have releasably secured thereto a cap to cover said ink applicator.

6. The bottle of claim 1 wherein said central recessed portion of said sidewall merges with said sidewall of said base portion at a lower flared surface, said lower flared surface being similar in shape to said upper flared surface.

7. The bottle of claim 1 wherein said shoulder portion also includes a conical surface terminating in said top wall, said top wall having a circular periphery centered about said central longitudinal axis.

8. The bottle of claim 1 wherein said predetermined outside diameter is approximately 1.665 inch (42.3 mm), and wherein said minor outside diameter is approximately 1.03 inch (26.2 mm).

9. The bottle of claim 1 wherein said bottle has a height of approximately 6 inches (15.2 cm).

10. The bottle of claim 1 wherein said predetermined outside diameter is approximately 1.54 inch (39.12 mm), and wherein said minor outside diameter is approximately 1.012 inch (25.7 mm).

11. The bottle of claim 10 wherein said bottle has a height of approximately 5 inches (12.7 cm).

12. The bottle of claim 1 wherein said upper flared surface includes surface means for detering a person to place his/her thumb and index finger on the flared surface too close to the shoulder portion.

13. The bottle of claim 12 wherein said surface means comprises a plurality of ridges.

14. The bottle of claim 13 wherein said ridges extend across said flared surface generally perpendicularly to said central longitudinal axis.

15. The bottle of claim 1 wherein said upper flared surface is a concave arcuate surface for receiving the thumb and the index finger.

* * * * *